United States Patent [19]

Baker

[11] Patent Number: 4,507,989

[45] Date of Patent: Apr. 2, 1985

[54] RATCHET TOOL

[76] Inventor: Rodney W. Baker, 60 Oranga St., New Plymouth, New Zealand

[21] Appl. No.: 438,966

[22] Filed: Nov. 3, 1982

[30] Foreign Application Priority Data

Nov. 3, 1981 [NZ] New Zealand ..... 198861
Jan. 29, 1982 [NZ] New Zealand ..... 199602

[51] Int. Cl.[3] ..... B25B 13/46

[52] U.S. Cl. ..... 81/57.39; 81/57.46; 81/58.1

[58] Field of Search ..... 81/57.39, 58.1, 57.46

[56] References Cited

U.S. PATENT DOCUMENTS 2,578,686 12/1951 Fish ..... 81/57.39
2,708,383 5/1955 Herbst et al. ..... 81/57.39
2,726,563 12/1955 Blackburn ..... 81/58.1
2,954,715 10/1960 Wycech ..... 81/58.1
4,224,844 9/1980 Henriksen ..... 81/57.46

*Primary Examiner*—James G. Smith
*Assistant Examiner*—J. T. Zatarga
*Attorney, Agent, or Firm*—Ladas & Parry

[57] ABSTRACT

A ratchet tool comprises a tubular body (1) with a handle (2) at one end and a ratchet drive (3) at the other end. The handle mounts a lever mechanism (12) which is operatively connected to the ratchet drive (3) by a plunger (4), a gear mechanism (7) and a flexible member (8). When the lever mechanism (12) is operated linear movement of the plunger (4) translates through the gear mechanism (7) and the flexible member (8) into rotary motion of the ratchet drive (3). With the lever mechanism (12) removed the ratchet tool can be used as a conventional ratchet.

6 Claims, 8 Drawing Figures

RATCHET TOOL

This invention relates to ratchet tools.

There are many situations in the service or manufacturing industries, and elsewhere, where a tool whether it is a hand tool or a machine tool is required to rotate an object to which direct access may not be possible. By way of example, vehicle service mechanics are often faced with a situation where they are required to tighten or loosen a nut in a position which restricts the usefulness of a conventional ratchet or other tools. The conventional ratchet spanners are generally used in these situations, however, the mechanics of these spanners is such that a radial movement of the handle and some free space is required to effect turning at the socket and furthermore, especially in confined spaces, it may only be possible to obtain small incremental turns to an object to which the tool is applied.

It is an object of the present invention to provide a ratchet tool.

It is a further object of the present invention to provide a ratchet tool which in use will overcome the limitations and disadvantages of existing tools, particularly in the situations described.

Further objects and advantages of the present invention will become apparent from the ensuing description which is given by way of example.

For convenience herein the present invention is described as a ratchet tool and although it is to be appreciated that within this definition it is intended to include hand held and operated tools as well as power tools designed for similar operations.

According to the present invention therefor there is provided a ratchet tool comprising a tubular body having a handle at one end and a ratchet drive at the other end, a plunger disposed within the body, a drive mechanism connecting the plunger with the ratchet drive, return bias means arranged to apply a return bias to the plunger or the drive mechanism, said drive mechanism comprising a gear mechanism operatively connected to said plunger and a flexible member interposed between and connected to said gear mechanism and the ratchet drive, the arrangement being such that upon reciprocation of the plunger the linear motion of the plunger is translated into a rotational motion of the said ratchet head.

Figure 5:
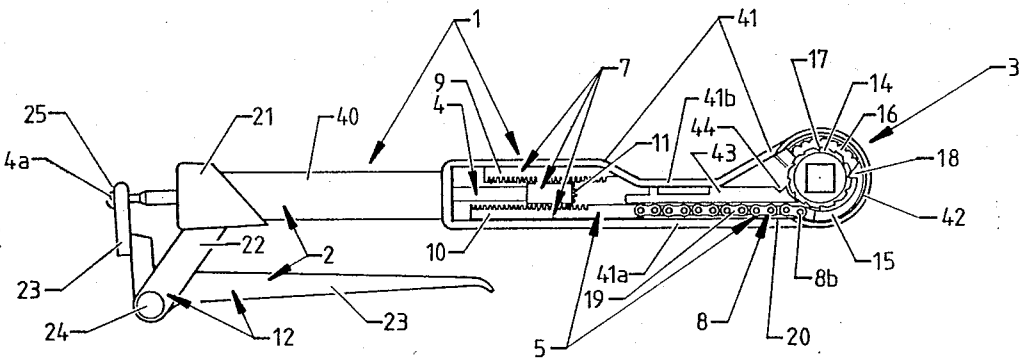
Figure 1:
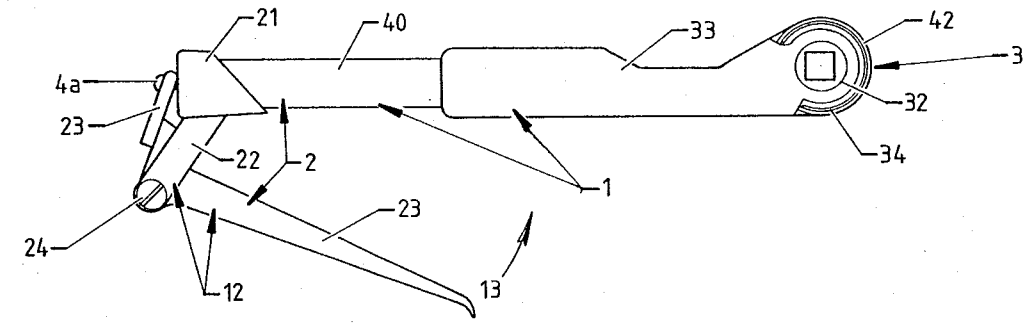
Figure 4:
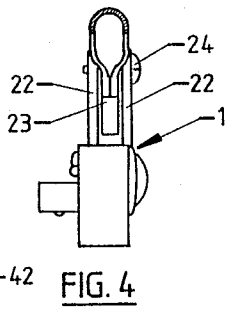
Figure 3:
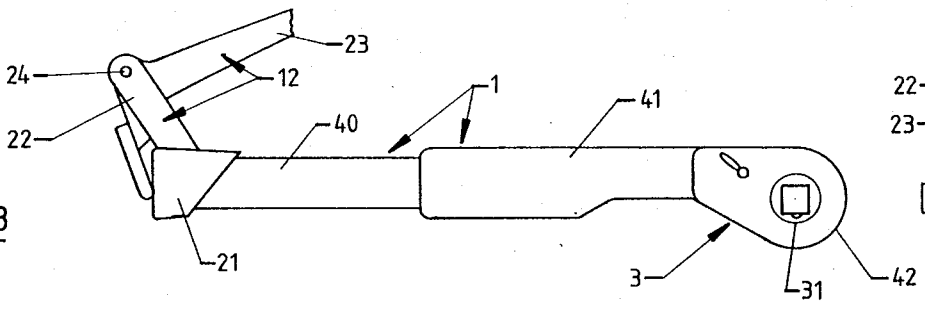
Figure 2:
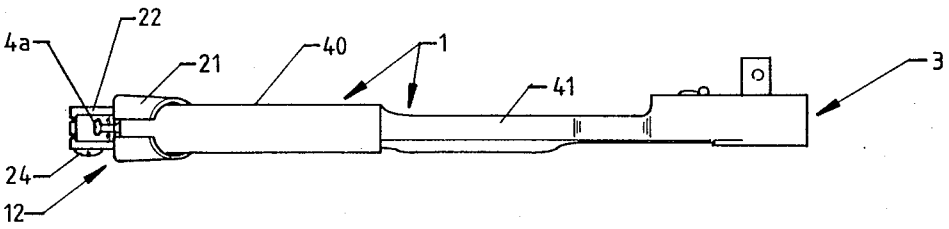
Figure 6:
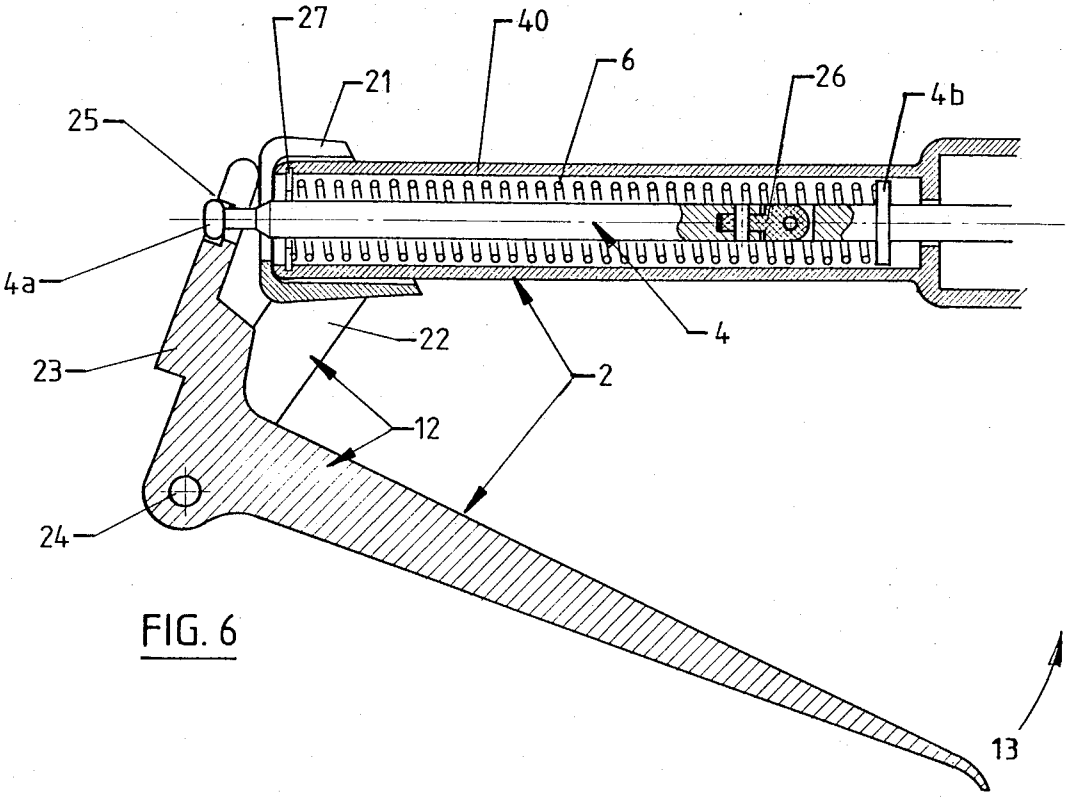
Figure 7:
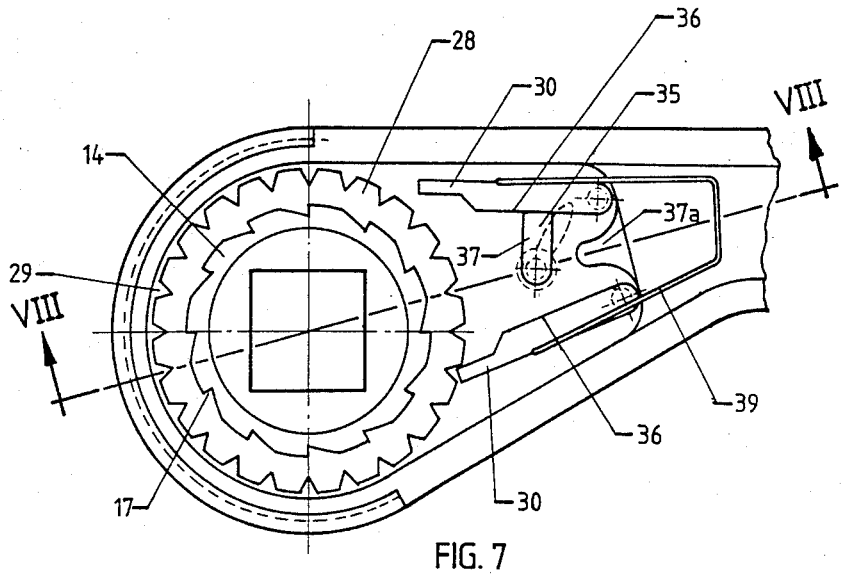
Figure 8:
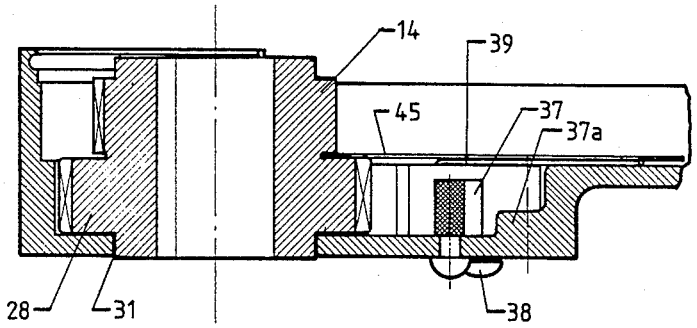

Aspects of the present invention will now be described by way of example only with reference to the accompanying drawings in which:

FIG. 1: is a top view of a ratchet tool in accordance with one possible embodiment of the present invention, and FIG. 2: is a side view of the ratchet tool of FIG. 1 taken in the direction of arrow 2, and FIG. 3: is a rear view of the hand tool illustrated by FIG. 1 with a lever therefor only partially shown, and FIG. 4: is an end view of the ratchet tool of FIG. 1, and FIG. 5: is a top view of the ratchet tool of FIG. 1 with a cover plate therefor removed, and FIG. 6: is a cross-section at the handle of the hand tool of FIG. 1, and FIG. 7: is a top view at the head of the hand tool of FIG. 1 with a drive chain for the tool and an intermediate cover plate removed, and FIG. 8: is a cross section at the head taken at VIII:-VIII of FIG. 7.

With reference to the drawings a ratchet tool in accordance with the present invention comprises a tubular body generally indicated by arrow 1 having a handle generally indicated by arrow 2 at one end and a head including a ratchet drive generally indicated by arrow 3 at the other end. A plunger mechanism generally indicated by arrow 4 is disposed within the body, together with a drive mechanism generally indicated by arrow 5 connecting the plunger 4 to the ratchet drive 3.

A return bias means such as a spring 6 is arranged to apply a return bias to the plunger 4 and/or the drive mechanism 5. The drive mechanism 5 comprises a gear mechanism generally indicated by arrow 7 operatively connected to the plunger 4 and a flexible member generally indicated by arrow 8 interposed and operatively connected to said gear mechanism 7 and the ratchet drive 3, the arrangement being such that upon reciprocation of said plunger 4 the linear motion of the plunger is translated into a rotational motion of the ratchet drive.

The gear mechanism comprises a fixed rack 9 mounted or intergrally formed with the body 1, a slidable rack 10, fixed to a first end of the flexible member 8 and a pinion 11 mounted for rotation on the end of the plunger 4 said pinion being arranged to constantly engage with the fixed and slidable racks 9 and 10 respectively.

The handle 1 for the ratchet tool can mount a lever mechanism generally indicated by arrow 12 which is connected to the end **4*a* of the plunger which extends from the body 1 the arrangement being such that inward movement of the lever 12 in the direction of arrow 13 imparts a pulling outward movement on the plunger 4**.

A second end **8*b* of the flexible member 8 engages about the periphery of a wheel 14 of the ratchet drive 3 and is provided with an arcuate connector 15 accommodated within a channel 16 formed between the wheel 14 and the body 1** of the hand tool at the head of the ratchet tool.

The wheel 14 is a gear wheel having a plurality of spaced notches 17 on the outer periphery thereof and the arcuate connector 15 is provided with a notch engaging member 18 arranged to positively locate in the notches 17 when the flexible member is pulled in its driving direction and to slip when the flexible member is rotated in the opposite direction.

The flexible member 8 includes an intermediate section of link chain 19 interposed between the sliding rack 10 and the arcuate connector 15 said section of link chain being arranged to reciprocate in a linear channel 20 situated between the gear mechanism 7 and the ratchet drive 3.

The lever 12 can comprise an end cap 21 rotatably mounted on the end of the handle 2, a bracket 22 extending outwardly therefrom and a substantially L-shaped trigger 23 pivotably connected to said bracket 22 by a pivot pin 24, the trigger having an inwardly directed part 25 arranged to engage with the extending end **4*a* of the plunger the arrangement being such that the lever mechanism 12** can be rotated to any desired radial position by a user.

In the embodiment illustrated the return bias means 6 is a coil spring mount coaxially with the plunger 4 and positioned within the handle 2 such that it applies a return bias to the plunger 4.

With reference specifically to FIG. 6 the plunger 4 may be provided with a universal joint 26 allowing one part of the plunger to be rotated with respect to the other and the coil spring 6 can be located by a cap 4*b* for the plunger locating one end of the spring and a washer locating the other end of the spring.

With reference specifically to FIGS. 7 and 8 of the drawings the ratchet drive 3 for a ratchet tool in accordance with the present invention can comprise a ratchet gear 28 mounted for rotation with respect to a complementary substantially circular chamber 29 of the body 1 wherein the direction of rotation of the ratchet gear 28 is controlled by a duel action pawl 30 to lock the drive mechanism or release it for rotation in one direction, but not the other. For convenience the ratchet gear 28 may be intergrally formed with the wheel 14 and the combined wheel and gear can be mounted for rotation with respect to locating apertures 31 and 32 formed in the body 1 and a cover plate 33 for the gear mechanism 7 with which can be made to be detachable from the tools and locatable by a semi-circular locating pin 34. The pawl 30 can be locked in position by a conventional pawl lock 35, which can be pivotably connected between the arms 36 of the pawl, which comprise a stop 37 and an outside lever 38. The pawl arms 36 can be joined by a spring 39 in the conventional manner, and the lever 38 is stopped from making a full turn by shoulder 37*a*.

The body 1 of the hand tool which can be fabricated or moulded in steel or any other suitable material and comprises a substantially circular cross-section portion 40 which accomodates the plunger and which forms the handle 2, a substantially rectangular cross-section intermediate portion 41 which houses the drive mechanism 7 and a substantially circular end portion 42 which houses the ratchet drive 3.

The lever mechanism 12 comprising the end cap 21, bracket 22 and the rigger is designed to be removed from the ratchet tool such that the ratchet tool can be used in the same way that a standard ratchet tool is used to perform the same functions. To remove the lever mechanism 12 the pivot pin 24 is removed and the inwardly directed part 25 is disengaged with the extending end 4*a* of the plunger 4. The end cap 21 may then be removed and the exposed end of the plunger 4 can be covered by a separate cap (not shown), although this is not necessary.

The channel 20 which accommodates the link chain 19 can be defined by one wall 41*a* of the intermediate portion 41 of the body 1 and an elongate guide 43 which is fixed to the opposite wall 41*b* of the intermediate section 41. The guide 43 is provided with end 44 which is shaped to be complementary with the end 18 of the arcuate member 15 and acts as a rest for the arcuate member as a result of release of the lever 12. A partition 45 is located beneath the link chain 19 and the guide 43 and above the pawl 30.

Aspects of the present invention have been described by way of example only and it will be appreciated that modifications and additions thereto may be made without departing from the spirit of the invention as defined in the appended claims.

I claim:

1. A ratchet tool comprising a tubular body having a handle at one end and a ratchet drive at the other end, a plunger disposed within the body, a drive mechanism connecting the plunger with the ratchet drive, return bias means arranged to apply a return bias to the plunger of the drive mechanism, said drive mechanism comprising a flexible member having one end connected to the ratchet drive and the other end connected to a gear mechanism which includes a fixed rack mounted within the body, a slidable rack fixed as aforesaid to the flexible member and a pinion mounted for rotation on one end of the plunger, the arrangement being such upon reciprocation of said plunger the linear motion of the plunger is translated into rotational motion of said ratchet drive.

2. A ratchet tool as claimed in claim 1 wherein the handle mounts a lever which is connected to an end of the plunger which extends from the body the arrangement being such that inward movement of the lever will impart a pulling outward movement of said plunger.

3. A ratchet tool as claimed in claim 2 wherein a second end of the flexible member engages about the periphery of a wheel of the ratchet drive and is provided with an arcuate connector accommodated within a channel formed between the wheel and the body and the hand tool.

4. A ratchet tool as claimed in claim 3 wherein the wheel is a gear wheel having a plurality of spaced notches in the outer periphery thereof and the arcuate connector is provided with a notch engaging member arranged to positively locate in spaced notches when the flexible member is pulled in its driving direction and to slip when the flexible member is rotated in the opposite direction.

5. A ratchet tool as claimed in 4 wherein the flexible member includes a section of link chain interposed between the sliding rack and the arcuate connector, said section of link chain being arranged to reciprocate in a linear channel within the body between the gear mechanism and the ratchet drive.

6. A ratchet tool as claimed in claim 2 wherein the lever comprises an end cap rotatably mounted on the end of the handle, a bracket extending outwardly therefrom and a trigger pivotably connected to said bracket, said trigger having an inwardly directed part rotatably engaging with the extending end of the plunger, the arrangement being such that the lever can be rotated to any desired radial position by a user.

* * * * *